US011060338B2

(12) United States Patent
Reid et al.

(10) Patent No.: US 11,060,338 B2
(45) Date of Patent: Jul. 13, 2021

(54) DOOR CLOSER

(71) Applicant: Galeid Ltd., Preston (GB)

(72) Inventors: Alister Peter Reid, Preston (GB); Philip Gallagher, Preston (GB)

(73) Assignee: GALEID LTD., Preston (GB)

( * ) Notice: Subject to any disclaimer, the term of this patent is extended or adjusted under 35 U.S.C. 154(b) by 0 days.

(21) Appl. No.: 16/606,170

(22) PCT Filed: Apr. 18, 2018

(86) PCT No.: PCT/EP2018/059915
§ 371 (c)(1),
(2) Date: Oct. 17, 2019

(87) PCT Pub. No.: WO2018/192980
PCT Pub. Date: Oct. 25, 2018

(65) Prior Publication Data

US 2020/0123828 A1 Apr. 23, 2020

(30) Foreign Application Priority Data

Apr. 18, 2017 (GB) ..... 1706124

(51) Int. Cl.
*E05F 1/08* (2006.01)
*E05F 1/10* (2006.01)
*E05F 3/10* (2006.01)

(52) U.S. Cl.
CPC ..... *E05F 1/105* (2013.01); *E05F 3/108* (2013.01); *E05Y 2201/41* (2013.01); *E05Y 2201/46* (2013.01); *E05Y 2900/132* (2013.01)

(58) Field of Classification Search
CPC ... E05F 1/105; E05F 3/108; E05F 3/02; E05F 3/04; E05Y 2201/46; E05Y 2201/462;
(Continued)

(56) References Cited

U.S. PATENT DOCUMENTS 370,468 A * 9/1887 Griffing et al. ..... E05F 3/20 16/68
1,521,162 A * 12/1924 Meagher ..... B66B 13/08 49/359

(Continued)

FOREIGN PATENT DOCUMENTS

CN 102667041 A 9/2012
DE 202010005948 U1 * 7/2010 ..... E05F 5/027

(Continued)

OTHER PUBLICATIONS

GB Search Report for GB Application No. 1706124.3 dated Oct. 2, 2017.

(Continued)

*Primary Examiner* — Chuck Y Mah
(74) *Attorney, Agent, or Firm* — Brandon V. Zuniga; James R. Gourley; Carstens & Cahoon, LLP

(57) ABSTRACT

A door closer having an elongate housing for mounting in a door leaf or door frame, the elongate housing having opposite forward and rear end parts, a plunger disposed in and movable along the housing, the plunger including a ferromagnetic material, a spring biasing element disposed in the housing and applying a first biasing force to bias the plunger inwardly of the housing and away from the forward end part and towards the rear end part, a tension member having a first end connected to the plunger and a second end connected to an anchor element assembly, the anchor element assembly comprising a mounting member for mounting in the other of the door leaf or door frame, the tension member and anchor element forming a tension assembly which extends through the forward end part.

20 Claims, 5 Drawing Sheets

(58) Field of Classification Search
CPC ..... E05Y 2201/41; E05Y 2201/474; E05Y 2201/412; E05Y 2900/132; Y10T 16/593; Y10T 16/568; Y10T 16/2799; Y10T 16/287; Y10T 16/281
See application file for complete search history.

(56) References Cited

U.S. PATENT DOCUMENTS

| | | | | | |
|---|---|---|---|---|---|
| 1,730,948 | A * | 10/1929 | Rosenthal | E05F 1/105 | 16/78 |
| 4,102,006 | A * | 7/1978 | Jenkins | E05F 3/108 | 16/51 |
| 4,285,094 | A * | 8/1981 | Levings, Jr. | E05F 3/22 | 16/52 |
| 4,686,739 | A * | 8/1987 | Fritsche | E05F 3/10 | 16/62 |
| 4,920,609 | A * | 5/1990 | Lin | E05C 17/085 | 16/66 |
| 5,170,530 | A * | 12/1992 | Kopec | E05F 3/108 | 16/52 |
| 5,432,977 | A * | 7/1995 | Reid | E05F 3/108 | 16/52 |
| 5,956,806 | A * | 9/1999 | Tutikawa | E05F 3/02 | 16/49 |
| 6,167,589 | B1 | 1/2001 | Luedtke | | |
| 6,871,381 | B1 * | 3/2005 | Luca | E05F 3/108 | 16/52 |
| 9,840,862 | B2 * | 12/2017 | Kadus | E05D 7/00 | |
| 2009/0241287 | A1 * | 10/2009 | Reid | E05F 3/108 | 16/58 |
| 2013/0097805 | A1 | 4/2013 | Bland et al. | | |

FOREIGN PATENT DOCUMENTS

| | | | |
|---|---|---|---|
| DE | 102013224075 | B3 | 3/2015 |
| EP | 2508703 | A2 | 10/2012 |
| FR | 1373516 | | 12/1963 |
| GB | 2446807 | | 8/2008 |
| WO | 2011/051317 | | 5/2011 |

OTHER PUBLICATIONS

PCT Search Report and Written Opinion for PCT Application No. PCT/EP2018/059915 dated Aug. 3, 2018.
Search Report and Written Opinion for SG Application No. 11201909660V dated Oct. 2, 2020 (10 pages).
Office Action for Chinese Application No. 201880033839.1 dated Feb. 2, 2021, including English translation (14 pages).

* cited by examiner

DOOR CLOSER

CROSS-REFERENCE TO RELATED APPLICATIONS

This application is a US 371 Application from PCT/EP2018/059915 filed Apr. 18, 2018 and GB Application No. 1706124.3 filed Apr. 18, 2017, the technical disclosures of which are hereby incorporated herein by reference.

BACKGROUND OF THE INVENTION

Field of the Invention

This invention relates to a door closing device for urging an opened door towards its closed position relative to a door frame.

More particularly, the invention concerns improvements in a door closer, which is of the kind that usually acts between a door leaf and a doorframe. This type of door closer typically comprises a housing, a plunger movable along the housing, a biasing element disposed in the housing and biasing the plunger inwardly of the housing, and a tension member having one end connected to the plunger and another end, which extends to an anchor element, The housing is normally installed in a bore in the door leaf and the anchor element installed in the doorframe. However, the positions of the housing and the anchor element may be reversed. The biasing element comprises a spring, which operates to bias the plunger, and consequently the tension member, inwardly of the housing, for closing the door. The tension member comprises an articulated element so that the tension member can be bent around the opening angle of the door relative to the door frame.

Description of Related Art and Deficiencies Recognized by the Inventors

It is known to provide such concealed door closers with a hydraulic damping assembly, as disclosed for example in the Applicant's earlier WO-A-2005/1 24079, WO-A-2008/102115, GB-A-2446807, WO-A-2009/034310, WO-A-2011051317 and WO-A-2012/076662. The hydraulic damping assembly comprises a piston and cylinder assembly that can damp the movement of the plunger. The hydraulic damping assembly comprises circuit for the hydraulic fluid that incorporates an adjustable needle valve assembly. The needle valve can be adjusted to vary the damping force of the hydraulic damping assembly. US-A-2013/0097805, U.S. Pat. No. 6,167,589 and FR-A-1373516 disclose door closer incorporating one or more magnets.

There is a general need for such concealed door closers to have a structure to enable them to be incorporated into a variety of different door constructions having a variety of different uses. For example, the British Standard BS.EN 1154:1997, and its equivalent European Standard EN 1154:1996+A1:2002 E dated up to February 2006, sets a variety of technical criteria required to be met by door closers, concealed or not.

One criterion is that the door closer must have a set "door closer power size" which is measured according to a precise testing protocol specified in the standard. The "door closer power size" increases within a range from power size 1 to power size 7. The power size categorizes the closing moment applied by the door closer to the door, and the ability of a door closer to apply a closing moment which overcomes any resistance to closing from a latch mechanism. This categorizes the closing moment over the last 4 degrees of opening angle of the door as the door is closed. When buildings are designed or specified by an architect, specific doors are specified to have a door closer of a particular power size, and some door closers are required by regulations to have a particular minimum power size for a particular installation. For example, a door may be required to be fitted with a power size 3 door closer.

The standards identified above also specify a minimum closing time at particular specified temperatures, which is to ensure that the door closer can properly and promptly act to close the door in the event of a fire. The BS.EN1154:1997 and EN 1154:1996+A1:2002 E standards specify the following: A. A standard closing time of 5 seconds at +20° C.; B. A minimum closing time of 3 seconds at +40° C.; and C. A maximum closing time of 25 seconds at −15° C. It is essential that the door closer overcomes any latching force to be able to achieve the minimum closing time.

While some exposed door closers that are fitted between the top of the door leaf and the door frame can meet these criteria of BS.EN 1154:1997 and EN 1154:1996+A1:2002 E, there is a need in the art for a concealed door closer that can readily meet these criteria in a cost-effective manner.

Normally, concealed door closers are sold as a range of products similar in construction but having a range of closing forces, higher closing forces being required for closing heavier doors. The closing forces are specified as the power size.

One problem with concealed door closers having a high power size is that the door can be difficult to open to a full opening angle, particularly when opened by frail or elderly people or by children. A spring mechanism provides the closing moment which determines the power size, but the spring mechanism correspondingly provides a resistance to opening. A higher power size concealed door closer can provide the required closing moment, but can be difficult to open.

There is therefore a need for a concealed door closer which can meet the criteria of BS.EN 1154:1997 and EN 1154:1996+A1:2002 E to provide a particular power size, and a minimum closing moment when the door leaf is closed, but can be easier to open to a full opening angle.

BRIEF SUMMARY OF THE INVENTION

The present invention at least partially aims to overcome the problems of the known door closers described hereinabove.

Accordingly, the present invention provides a door closer for mounting between a door leaf and a door frame, the door closer comprising: an elongate housing for mounting in one of the door leaf or door frame, the elongate housing having opposite forward and rear end parts, a plunger disposed in and movable along the housing, the plunger including a ferromagnetic material, a spring biasing element disposed in the housing and applying a first biasing force to bias the plunger inwardly of the housing and away from the forward end part and towards the rear end part, a tension member having a first end connected to the plunger and a second end connected to an anchor element assembly, the anchor element assembly comprising a mounting member for mounting in the other of the door leaf or door frame, the tension member and anchor element forming a tension assembly which extends through the forward end part, and a magnetic biasing element disposed in the housing and applying a second biasing force to the ferromagnetic material to bias the plunger inwardly of the housing and away from the forward end part and towards the rear end part, wherein the spring biasing element is adapted to apply the first biasing force over a first movement range of the plunger within the housing and the magnetic biasing element is adapted to apply the second biasing force over a second movement range of the plunger within the housing, the first movement range defining a forwardmost position of the plunger within the housing and the second movement range defining a rearmost position of the plunger within the housing.

Preferably, the door closer is a variable power door closer, wherein the second movement range is externally adjustable to adjust a distance over which the second biasing force is applied to the plunger within the housing, the adjustment varying the minimum closing moment when the door leaf is closed by the door closer, and thereby varying the power of the door closer.

Preferably, the door closer further comprises an adjustable fixing mechanism for the magnetic biasing element, the adjustable fixing mechanism being adapted to adjust the second movement range by adjusting a translational position of the magnetic biasing element within the housing, the adjustable fixing mechanism extending externally of the housing so that the adjustable fixing mechanism can be adjusted externally by the user.

In the preferred embodiments of the door closer of the present invention, the door closer further comprises an elongate fixing element slidably fitted to the plunger and extending along the housing and fitted to an end element at the rear end part, and the magnetic biasing element is fixed to the elongate fixing element. In these embodiments the adjustable fixing mechanism comprises or is the elongate fixing element, and the magnetic biasing element is preferably movably, e.g. threadably, fixed to the elongate fixing element and can be moved therealong. The elongate fixing element is preferably rotatably fitted to the end element at the rear end part, and rotation of the elongate fixing element causes the magnetic biasing element to be moved translationally along the elongate fixing element.

The preferred embodiments of the present invention can provide a concealed door closer that is structured to provide a spring bias, in the closing direction, which provides a relatively low resistance against opening of the door over the entire opening angle range of the door, for example from a 0 degree opening angle to an opening angle of 90 degrees or higher. The additional magnetic bias, in the closing direction, provides an additional resistance against opening of the door over only an initial portion of the opening angle range of the door, for example from a 0 degree opening angle to an opening angle of up to 4 degrees. When the door is initially held open about a large opening angle, to enable a person to pass through the doorway, and then released, the spring bias urges the door to close from the opening angle and the spring bias acts over the entire opening angle until the door is fully closed, and the additional magnetic bias provides an additional closing force on the door over the last portion of the opening angle which reliably overcomes any resistance to full closing which may be provided by the latch mechanism of the door. The additional magnetic bias ensures that the door is reliably fully closed. When the door is opened from the closed position, the spring bias provides a resistance to opening which acts over the entire opening angle and the additional magnetic bias provides an additional resistance to opening which only acts over the initial portion of the opening angle. After the door has been opened by the initial portion of the opening angle, example from a 0 degree opening angle to an opening angle of up to 4 degrees, the additional magnetic bias becomes zero, and only the spring bias provides a resistance to opening. The overall result is that the combination of the spring bias and the magnetic bias provide a concealed door closer which can provide a sufficiently high closing force, or power size (for example as defined in BS.EN 1154:1997 and EN 1154:1996+A1:2002 E), to reliably ensure closing of any given door, but provide a lower resistance to opening over a majority of the opening angle, after an initial small opening angle. Once a person opening the door has opened the door the initial opening angle, the resistance to opening suddenly decreases because the additional magnetic bias suddenly disappears. The result is an easier-to-open door without compromising the power size of the concealed door closer.

The preferred embodiments of the present invention provide that the concealed door closer has an adjustable power size. In particular, the concealed door closer is adapted so that the user is able to adjust the minimum closing moment when the door leaf is closed, which is achieved by providing that the second movement range is adjustable by adjusting the translational position of the magnetic biasing element within the housing by operation of an adjustable fixing mechanism for the magnetic biasing element, the adjustable fixing mechanism extending externally of the housing. External adjustment of the second movement range adjusts the distance over which the second biasing force is applied to the plunger within the housing. This adjustment varies the minimum closing moment when the door leaf is closed, and thereby adjusts the power size of the concealed door closer.

In particular, the plunger may further comprise a hydraulic damper for damping, or decelerating, the movement of the plunger within the housing. The preferred embodiments of the present invention can provide a concealed door closer that can readily be structured to provide the minimum door closing time required by BS.EN 1154:1997 and EN 1154:1996+A1:2002 E in a cost-effective manner, since a valve structure can be manufactured for use with a variety of different viscosity hydraulic fluids in the hydraulic damper and with a variety of different spring closing forces.

BRIEF DESCRIPTION OF THE SEVERAL VIEWS OF THE DRAWING(S)

An embodiment of the present invention will now be described, by way of example only, with reference to the accompanying drawings in which.

Figure 1:
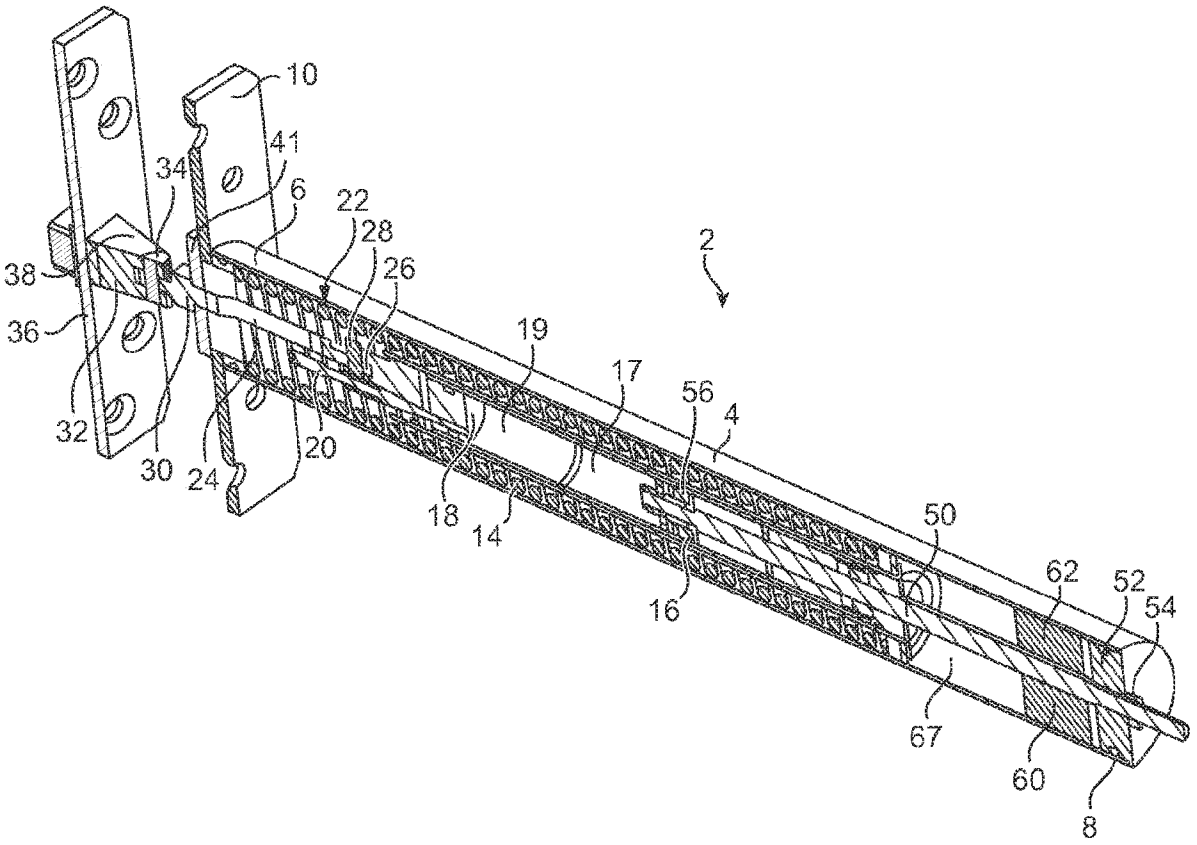
FIG. 1 is a rear perspective cross-sectional side view of a door closer according to an embodiment of the present invention in a partly open configuration.
Figure 2:
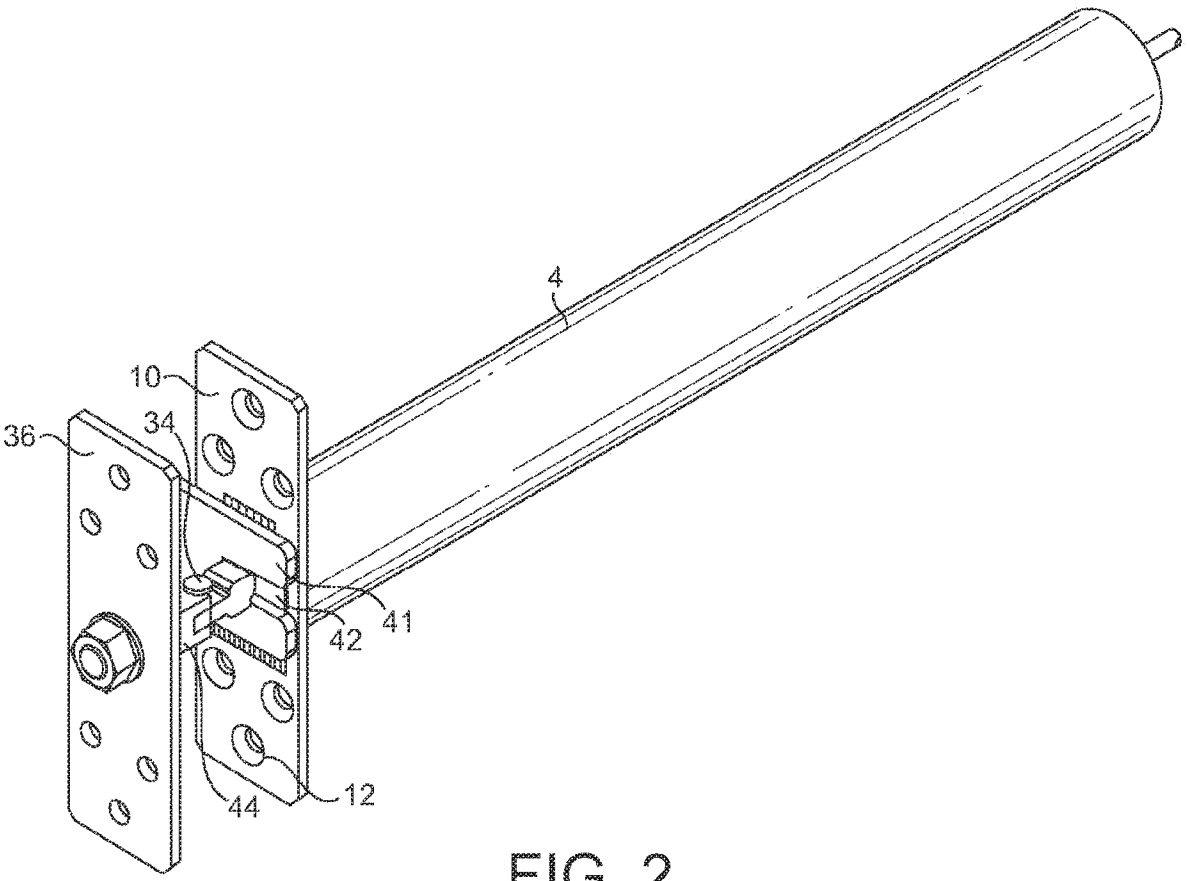
FIG. 2 is a perspective front view of the door closer of FIG. 1.
Figure 5:
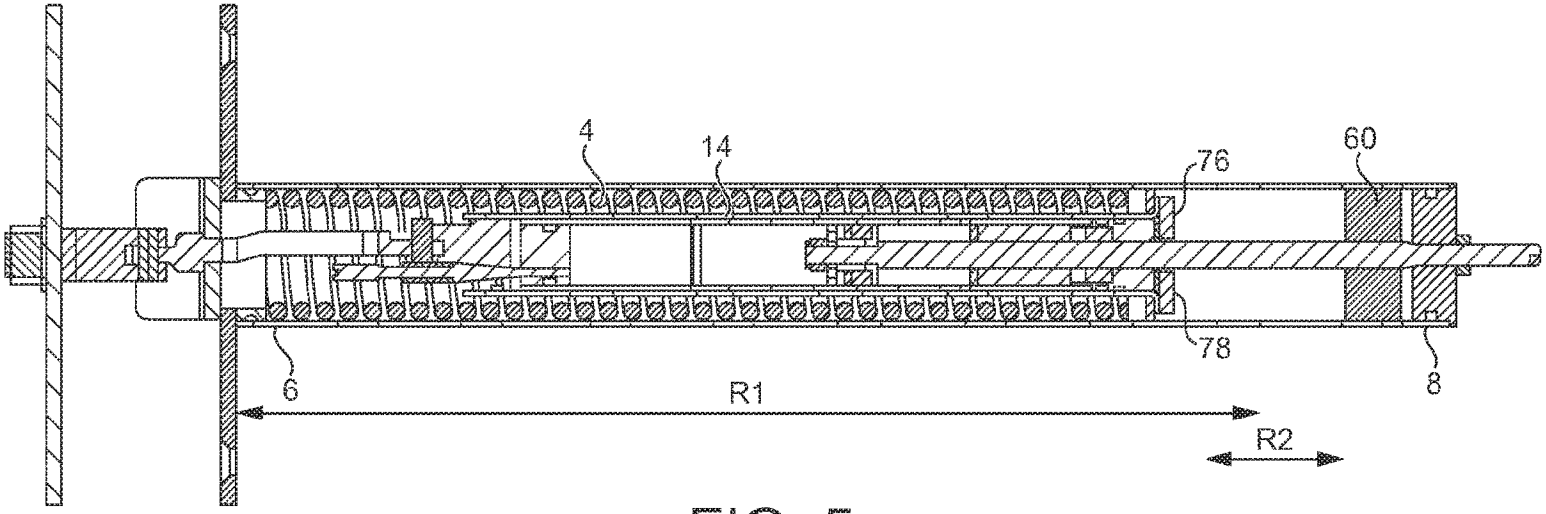
Figure 6:
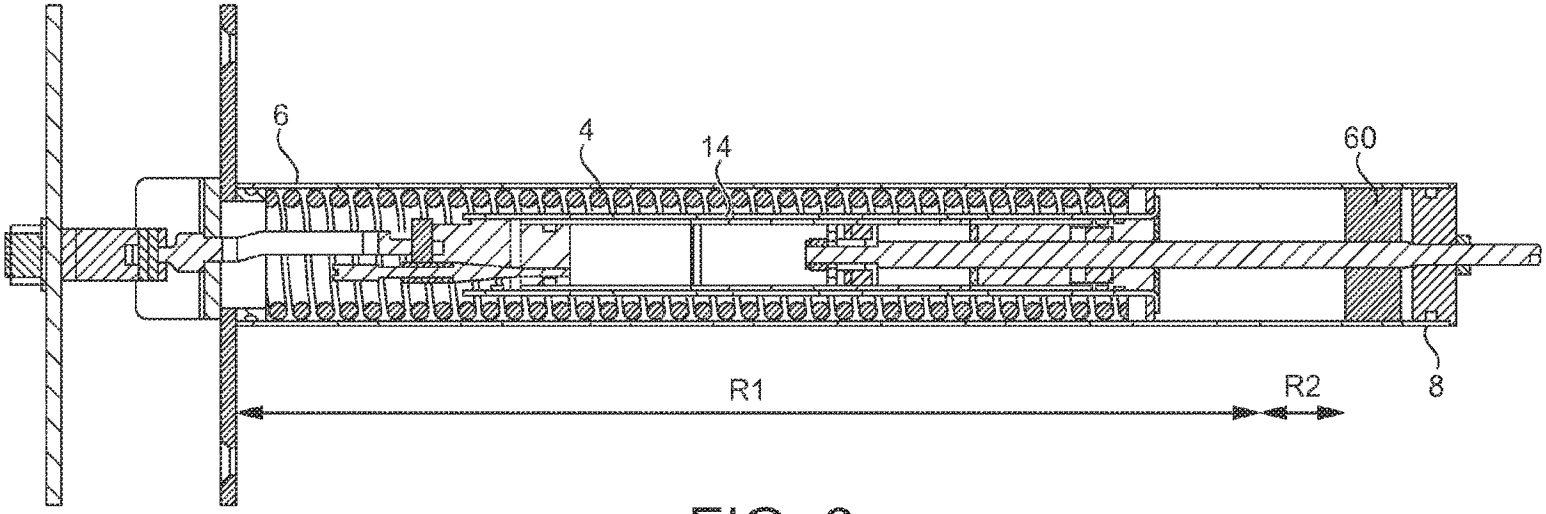
Figure 7:
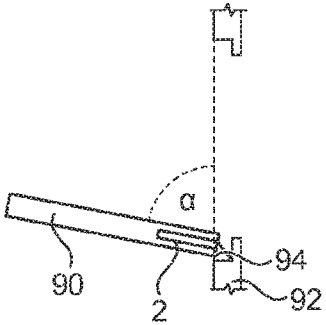

FIG. 5 schematically illustrates a second alternative relationship between the first and second biasing forces in accordance with another embodiment of the present invention;

FIG. 6 schematically illustrates a third alternative relationship between the first and second biasing forces in accordance with another embodiment of the present invention; and FIG. 7 schematically illustrates the door closer of FIG. 1 mounted between a door leaf and a door frame.

FIGS. 1 to 4 show a door closer 2 according to the present invention that can be used for urging an opened door towards its closed position relative to a door frame. The door closer 2 is adapted for mounting between a door leaf and a door frame. The door closer 2 comprises an elongate housing 4 for mounting in one of the door leaf or door frame. The elongate housing 4 has opposite forward and rear end parts 6, 8. The housing 4 is a cylindrical tube, typically of steel. The housing 4 has a mounting plate 10 affixed thereto, the mounting plate 10 having holes 12 extending therethrough for receiving fixing screws. In use, the housing 4 is received in an elongate horizontal cavity in a door leaf (not shown), and the mounting plate 10 is rebated into the edge of the door leaf and affixed thereto, for example by screws.

DETAILED DESCRIPTION

A plunger 14 is disposed in and movable along the housing 4. The plunger 14 further comprises a hydraulic damper 16 for damping, or decelerating, the movement of the plunger 14 within the housing 4. The hydraulic damper 16 includes a chamber 17 filled with hydraulic fluid 19 which causes damping of the door closer 2. The hydraulic damper 16 comprises a restrictor valve 18 having a threaded adjuster pin 20 for adjusting the damping operation of the hydraulic damper 16, as disclosed for example in the Applicant's earlier WO-A-2005/1 24079, WO-A-2008/102115, WO-A-2009/034310, WO-A-2011/051317 and WO-A-2012/076662.

The restrictor valve 18 is configured to be adjustable after installation, and permits a user readily to achieve fine control of the damping function and the criteria of BS.EN 1154:1997 and EN 1154:1996+A1:2002 E to be achieved over a wide temperature range with a variety of hydraulic fluids. Most particularly, such fine control can be achieved even with a hydraulic fluid of low viscosity, such as 60 centistokes at room temperature, the advantage of such a low viscosity fluid being the minimization of the risk of jamming of the door closer, particularly at lower operating temperatures. The concealed door closer can meet the criteria of BS.EN 1154:1997 and EN 1154:1996+A1:2002 E when using a variety of different hydraulic fluids without requiring a structural modification of the restrictor valve 18 structure dependent upon a selected hydraulic fluid or on the closing force or application of the door closer.

A spring biasing element 22, typically a helical compression spring 22, is disposed in the housing 4 and applies a first biasing force to bias the plunger 14 inwardly of the housing 4 and away from the forward end part 6 and towards the rear end part 8. The spring biasing element 22 annularly surrounds the plunger 14.

A rigid tension member 24 has a first end 26 pivotally connected to the plunger 14 at a first pivot 28 and a second end 30 pivotally connected to an anchor element assembly 32 at a second pivot 34. The anchor element assembly 32 comprises a mounting member 36, in the form of a plate 36, for mounting in the other of the door leaf or door frame, and an elongate link member 38, which extends forwardly from the mounting member 36, to which the rigid tension member 24 is connected by the second pivot 34.

The tension member 24 and anchor element assembly 32 form a tension assembly 40 which extends through the forward end part 6. A hole 42 in the mounting plate 10 permits movement therethrough of the rigid tension member 24 and the link member 38 forming the tension assembly 40. The hole 42 also permits insertion therethrough of a screwdriver or other tool to adjust the threaded adjuster pin 20 of the hydraulic damper 16.

In FIGS. 1 to 4 the door closer 2 is illustrated in a partly open configuration, in the configuration as shown, in which a U-shaped holder 41 is removably fitted to the tension member 24 in order temporarily to hold the second end 30 of the tension member 24 and the link member 38 out of the forward end part 6, against the bias of the helical compression spring 22, to aid installation of the door closer 2.

The mounting member 36 is typically rebated into the edge of the door frame and affixed thereto, for example by screws. The second pivot 34 is located at a free end 44 of the link member 38 remote from the plate member 36. The first and second pivots 28, 34 have parallel axes, which in use are typically vertically oriented.

Conceivably, the mounting positions of the housing 4 and the anchor element assembly 32 may be reversed, with the housing 4 received in the door frame and the anchor element assembly 32 mounted to the door leaf.

An elongate fixing element 50 is slidably fitted to the plunger 14. The elongate fixing element 50 extends along the housing 4 and through an end element 52 at the rear end part 8. The elongate fixing element 50 is freely rotatably fitted to the end element 52. A nut 54 is threadably fixed to the elongate fixing element 50 externally of the housing 4. A slider mechanism 56, including the hydraulic damper 16, is fitted to the elongate fixing element 50 within the plunger 14.

A magnetic biasing element 60 is disposed in the housing 4 and is fixed to the elongate fixing element 50. The magnetic biasing element 60 is movably fixed, typically threadably fixed, to the elongate fixing element 50 and can be moved therealong. The elongate fixing element 50 is freely rotatably fitted to the end element 52 at the rear end part 8. Rotation of the elongate fixing element 50 causes the magnetic biasing element 60 to be moved translationally along the elongate fixing element 50 in an inward or outward direction depending upon the direction of rotation of the elongate fixing element 50.

Figure 4:
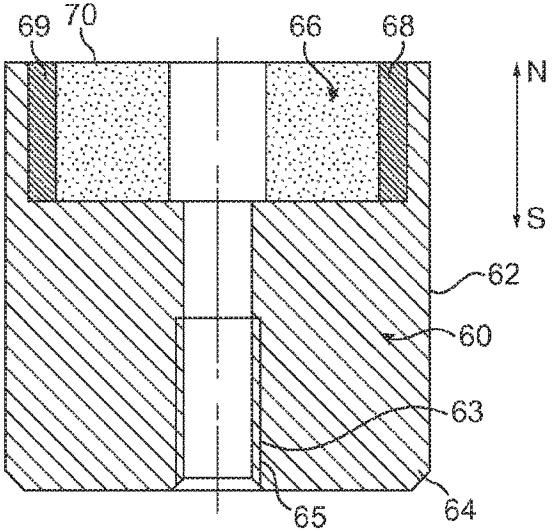
FIG. 4 is a cross-section through the magnetic biasing element in the door closer.

As shown in FIG. 4 in greater detail, the magnetic biasing element 60 is annular and has a cylindrical outer surface 62 and a central bore 63 with an internal helical thread 65 through which the elongate fixing element 50 extends via the threaded connection.

The magnetic biasing element 62 comprises a holder 64 composed of non-ferromagnetic material, such as nickel or a nickel alloy, which surrounds a magnet 66 of the magnetic biasing element 60. The holder 64 separates the magnet 66 from an annular wall 67 of the housing 4, to prevent the magnet 66 from inadvertently being clamped to the housing 4 by any magnetic force. The magnet 66 is fitted in a blind recess 68 in the holder 64 so that an exposed face 70 of the magnet 66 is oriented towards the plunger 14. An adhesive moulding compound 69 bonds the magnet 66 within the recess 68. Typically, the magnetic biasing element 60 comprises a Neodymium or NdFeB magnet 66, for example of grade N50 or N52.

The plunger 14 includes a ferromagnetic material 72. In the illustrated embodiment, the plunger 14 has an outer body 74 which is composed of steel which provides at least some of the ferromagnetic material 72 in the plunger 14. Optionally, as shown in FIG. 5, a second magnet 76 is fitted to a rear end 78 of the plunger 14 and the second magnet 76 provides at least some of the ferromagnetic material 72 in the plunger 14. Typically, the second magnet 76 comprises a Neodymium or NdFeB magnet, for example of grade N50 or N52, or an iron or steel magnet.

The magnetic biasing element 60 applies a second biasing force to the ferromagnetic material 72 to bias the plunger 14 inwardly of the housing 2 and away from the forward end part 6 and towards the rear end part 8.

Figure 3:
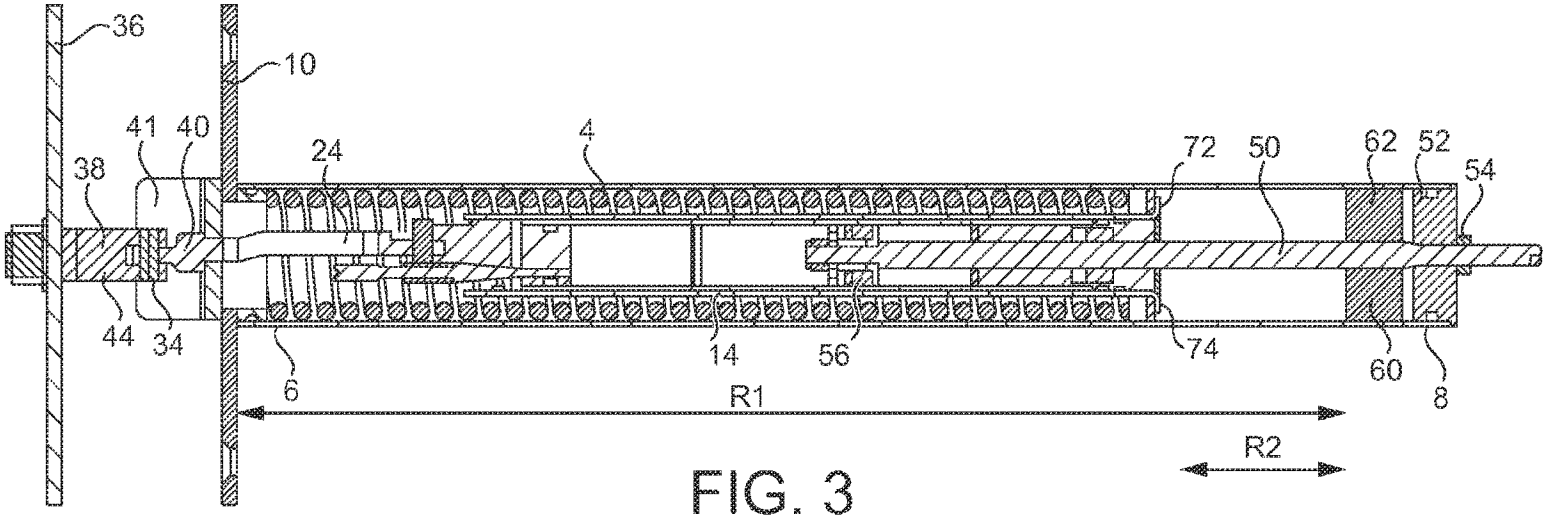
FIG. 3 is a cross-sectional side view of the door closer of FIG. 1 in the partly open configuration which also illustrates a first relationship between the first and second biasing forces in accordance with an embodiment of the present invention.

Referring to FIG. 3, the spring biasing element 22 is adapted to apply the first biasing force over a first movement range R1 of the plunger 14 within the housing 4 and the magnetic biasing element 60 is adapted to apply the second biasing force over a second movement range R2 of the plunger 14 within the housing 4. The first movement range R1 defines a forwardmost position of the plunger 14 within the housing 2 and the second movement range R2 defines a rearmost position of the plunger 14 within the housing 2.

The elongate fixing element 50 and the magnetic biasing element 60 are configured so that forward or rearward adjustment of the translational position of the magnetic biasing element relative to the plunger 14 respectively increase or decrease the application of the magnetic biasing force on the plunger 14.

The forward or rearward adjustment of the translational position of the magnetic biasing element 60 relative to the plunger 14 respectively increase and decrease the second movement range R2 and the proportion of the entire movement over which the magnetic biasing force is applied to the plunger 14.

The forward or rearward adjustment of the translational position of the magnetic biasing element 60 relative to the plunger 14 also respectively increase and decrease the second movement range R2 and the total biasing force applied to the plunger 14 over the second movement range R2.

The elongate fixing element 50 and magnetic biasing element 60 are configured so that each 360° revolution of the elongate fixing element 50 increases or decreases the total biasing force applied to the plunger 14 over the second movement range R2. Typically, each 360° revolution of the elongate fixing element 50 increases or decreases the total biasing force applied to the plunger 14 over the second movement range R2 by a biasing force of from 0.5 to 2 Nm, optionally from 0.75 to 1.5 Nm.

The preferred embodiments of the present invention therefore provide that the concealed door closer 2 has an adjustable power size. In particular, the concealed door closer 2 is adapted so that the user is able to adjust the minimum closing moment when the door leaf is closed, which is achieved by providing that the second movement range R2 is adjustable by adjusting the translational position of the magnetic biasing element 60 within the housing 4 by operation of an adjustable fixing mechanism, exemplified by the elongate fixing element 50, for the magnetic biasing element 60, the adjustable fixing mechanism extending externally of the housing 4. The adjustable fixing mechanism, exemplified by the elongate fixing element 50, can be accessed by a user so that the device can be adjusted externally by the user. External adjustment of the second movement range R2 adjusts the distance over which the second biasing force is applied to the plunger 14 within the housing 4. This adjustment varies the minimum closing moment when the door leaf is closed, and thereby adjusts the power size of the concealed door closer 2.

In the embodiment shown in FIG. 3, the first movement range R1 defines a length of motion of the plunger 14 within the housing 4 over which the first biasing force from the spring is applied, for example over an opening range of from 0 degrees to greater than 90 degrees, and the second movement range R2, over which the second biasing force from the magnet(s) is applied, for example over an opening range of from 0 degrees to up to 4 degrees, overlaps with a rear part of the first movement range R1, and in the overlap of the first and second movement ranges R1, R2 the first and second biasing forces are additive to provide a total biasing force higher than the individual first and second biasing forces. The first movement range R1 typically defines the entire length of motion of the plunger 14 within the housing 4 and all of the second movement range R2 overlaps with the rear part of the first movement range R1.

Alternatively, as shown in FIG. 5, in another embodiment, the first movement range R1 defines a majority of the length of motion of the plunger 14 within the housing 4 and a front part of the second movement range R2 overlaps with the rear part of the first movement range R1.

In another embodiment, as shown in FIG. 6, the first movement range R1 defines a length of motion of the plunger 14 within the housing 4 located towards the forward end part 6 and the second movement range R2 is adjacent to, and does not overlap with, the first movement range R1, and defines a length of motion of the plunger 14 within the housing 4 located towards the rear end part 8.

The entire movement range of the plunger 14 from the forwardmost position to the rearmost position defines an angle of opening of the door.

Typically, the second biasing force is higher than the first biasing force. Typically, a total biasing force over the second movement range R2 is higher than the first biasing force.

Typically, the first biasing force is from 8 to 13 Nm, more typically from 8 to 10 Nm, such as from 8 to 9 Nm. Typically, the second biasing force is from 8 to 13 Nm. Typically, the total biasing force over the second movement range R2 is at least 13 Nm, more typically from greater than 13 Nm to up to 25 Nm, such as from greater than 13 Nm to up to 21 Nm.

In use, as shown in FIG. 7, the door closer 2 is mounted between a door leaf 90 and a door frame 92.

The door leaf 90 has a closing angle α which decreases to a closing angle of 0° as the door leaf 90 is closed, and the magnetic biasing element 60 is adapted to apply the second biasing force over only the range from 4 to 0° as the door leaf 90 is closed.

Over the range from 4 to 0° as the door leaf 90 is closed the door closer 2 applies a closing force on the door leaf 90 of at least 13 Nm, typically from greater than 13 Nm to up to 25 Nm, more typically from greater than 13 Nm to up to 21 Nm.

Over the range of at least 5° as the door leaf 90 is closed the door closer 2 applies a closing force on the door leaf 90 which is lower than the closing force over the range from 4 to 0°. For example, over the range of at least 5° as the door leaf 90 is closed the door closer 2 applies a closing force on the door leaf 90 which is less than 13 Nm, typically from 8 to less than 13 Nm, more typically from 8 to 10 Nm, such as from 8 to 9 Nm.

When the door leaf 90 is opened relative to the door frame 92 about the axis of one or more door hinges 94, the plunger 14, being attached to the door frame 92, is pulled in a direction outwardly of the housing 4. Accordingly, the helical compression spring 22 is progressively compressed, as a result of a compression force acting thereon by the plunger 14, and exerts an inward biasing force acting against the opening pulling force on the door leaf 90. For the initial opening movement from the closed position, the magnetic biasing element 60 provides a magnetic attractive force on the plunger 14 which resists the opening motion. After the door leaf 90 has been opened by an initial angle from the closed position, for example up to 4°, the magnetic attractive force is minimal, and becomes negligible, and only the spring bias from the helical compression spring 22 resists further opening of the door leaf 90.

The helical compression spring 22 provides a low resisting moment, for example within the range of 8 to 13 Nm, in which case the spring can effectively act as a power size 1 door closer over the majority of the opening angle after the initial opening angle from the closed position, for example up to 4°.

After the door leaf 90 is released, the biasing force of the helical compression spring 22 acts to bias the rigid tension member 24 and the plunger 14 inwardly of the housing 4, for closing the door. When the door leaf 90 is subsequently closed relative to the door frame 92 about the axis of the one or more door hinges 94, the plunger 14 is pushed in a direction inwardly of the housing 4 by the compressed helical compression spring 22 which exerts the inward biasing force acting as a closing force on the door leaf 90. For the initial opening movement from the open position, for example until the opening angle is as low as just above 4°, the sole closing moment applied by the door closer 2 on the door leaf 90 is applied by the helical compression spring 22.

As the door leaf 90 approaches the fully closed position, for example at which the door leaf 90 is at an opening angle of as low as 4°, the magnetic biasing element 60 acting on the plunger 14 provides an additional closing force on the plunger 14, additional to the spring bias from the helical compression spring 22 which assists the closing motion.

The combination of the helical compression spring 22 and the magnetic biasing element 60 provides a high closing moment, for example within the range of 13 to 18 Nm, in which case the combination can effectively act as a power size 2 door closer over the final few degrees of the closing angle, for example up to 4°. Alternatively, the combination of the helical compression spring 22 and the magnetic biasing element 60 provides an even higher closing moment, for example within the range of 18 to 25 Nm, in which case the combination can effectively act as a power size 3 door closer over the final few degrees of the closing angle, for example up to 4°.

These enhanced power sizes can provide increased closing power over the last few degrees of closing without increasing the opening resistance over the majority of the opening angle. The increased closing power can provide enhanced closing forces to overcome any resistance to closing by a latch or locking member for the door leaf 90 in the door frame 92.

The hydraulic damper 16 may provide a reduced damping force at the end of the closing operation so as to provide an enhanced closing velocity for overcoming any latch resistance so that the door leaf 90 is securely latched when closed.

Various modifications to the illustrated embodiment will be apparent to those skilled in the art.

The invention claimed is:

1. A door closer for mounting between a door leaf and a door frame, the door closer comprising: an elongate housing for mounting in one of the door leaf or door frame, the elongate housing having opposite forward and rear end parts, a plunger disposed in and movable along the housing, the plunger including a ferromagnetic material, a spring biasing element disposed in the housing and applying a first biasing force to bias the plunger inwardly of the housing and away from the forward end part and towards the rear end part, a tension member having a first end connected to the plunger and a second end connected to an anchor element assembly, the anchor element assembly comprising a mounting member for mounting in the other of the door leaf or door frame, the tension member and anchor element assembly forming a tension assembly which extends through the forward end part, a magnetic biasing element disposed in the housing and applying a second biasing force to the ferromagnetic material to bias the plunger inwardly of the housing and away from the forward end part and towards the rear end part, wherein the spring biasing element is adapted to apply the first biasing force over a first movement range of the plunger within the housing and the magnetic biasing element is adapted to apply the second biasing force over a second movement range of the plunger within the housing, the first movement range defining a forwardmost position of the plunger within the housing and the second movement range defining a rearmost position of the plunger within the housing, and an adjustable fixing mechanism for the magnetic biasing element, the adjustable fixing mechanism being adapted to adjust the second movement range by adjusting a translational position of the magnetic biasing element within the housing, the adjustable fixing mechanism extending externally of the housing so that the adjustable fixing mechanism can be adjusted externally by the user.

2. A door closer according to claim 1 which is a variable power door closer, wherein the second movement range is externally adjustable to adjust a distance over which the second biasing force is applied to the plunger within the housing, the adjustment varying the minimum closing moment when the door leaf is closed by the door closer, and thereby varying the power of the door closer.

3. A door closer according to claim 1 wherein the adjustable fixing mechanism comprises an elongate fixing element slidably fitted to the plunger and extending along the housing and fitted to an end element at the rear end part, and the magnetic biasing element is fitted to the elongate fixing element.

4. A door closer according to claim 3 wherein the magnetic biasing element is movably fitted to the elongate fixing element and can be moved therealong.

5. A door closer according to claim 4 wherein the magnetic biasing element is threadably fitted to the elongate fixing element.

6. A door closer according to claim 5 wherein the elongate fixing element is rotatably fitted to the end element at the rear end part, and rotation of the elongate fixing element causes the magnetic biasing element to be moved translationally along the elongate fixing element.

7. A door closer according to claim 6 wherein the elongate fixing element is freely rotatably fitted to the end element, and further comprising a nut threadably fitted to the elongate fixing element externally of the housing.

8. A door closer according to claim 6 wherein the elongate fixing element and the magnetic biasing element are configured so that forward or rearward adjustment of the translational position of the magnetic biasing element relative to the plunger respectively increase or decrease the application of the magnetic biasing force on the plunger.

9. A door closer according to claim 8 wherein the forward or rearward adjustment of the translational position of the magnetic biasing element relative to the plunger respectively increase and decrease the second movement range and the proportion of the entire movement over which the magnetic biasing force is applied to the plunger.

10. A door closer according to claim 8 wherein the forward or rearward adjustment of the translational position of the magnetic biasing element relative to the plunger respectively increase and decrease the second movement range and the total biasing force applied to the plunger over the second movement range.

11. A door closer according to claim 7 wherein the elongate fixing element and magnetic biasing element are configured so that each 360° revolution of the elongate fixing element increases or decreases the total biasing force applied to the plunger over the second movement range.

12. A door closer according to claim 11 wherein the elongate fixing element and magnetic biasing element are configured so that each 360° revolution of the elongate fixing element increases or decreases the total biasing force applied to the plunger over the second movement range by a biasing force of from 0.5 to 2 Nm, or from 0.75 to 1.5 Nm.

13. A door closer according to claim 1 wherein the first movement range defines a length of motion of the plunger within the housing and the second movement range overlaps with a rear part of the first movement range, and in the overlap of the first and second movement ranges the first and second biasing forces are additive to provide a total biasing force higher than the individual first and second biasing forces and wherein the first movement range defines the entire length of motion of the plunger within the housing and all of the second movement range overlaps with the rear part of the first movement range or wherein the first movement range defines a majority of the length of motion of the plunger within the housing and a front part of the second movement range overlaps with the rear part of the first movement range.

14. A door closer according to claim 1 wherein the first movement range defines a length of motion of the plunger within the housing located towards the forward end part and the second movement range is adjacent to, and does not overlap with, the first movement range, and defines a length of motion of the plunger within the housing located towards the rear end part.

15. A door closer according to claim 1 wherein an entire movement range of the plunger from the forwardmost position to the rearmost position defines an angle of opening of a door.

16. A door closer according to claim 1 wherein the second biasing force is higher than the first biasing force.

17. A door closer according to claim 1 wherein a total biasing force over the second movement range is higher than the first biasing force.

18. A door closer according to claim 1 mounted between a door leaf and a door frame, wherein the door leaf has a closing angle which decreases to a closing angle of 0° as the door leaf is closed, and the magnetic biasing element is adapted to apply the second biasing force over only the range from 4 to 0° as the door leaf is closed.

19. A door closer according to claim 18 wherein over the range from 4 to 0° as the door leaf is closed the door closer applies a closing force on the door leaf of at least 13 Nm, or from greater than 13 Nm to up to 25 Nm, or from greater than 13 Nm to up to 21 Nm.

20. A door closer according to claim 18 wherein over the range of at least 5° as the door leaf is closed the door closer applies a closing force on the door leaf which is lower than the closing force over the range from 4 to 0°.

* * * * *